United States Patent [19]

Van Der Zon

[11] Patent Number: 4,631,896

[45] Date of Patent: Dec. 30, 1986

[54] METHOD, APPARATUS AND BLANK FOR PACKING AT LEAST ONE ARTICLE IN A SELF-SUPPORTING WRAPPING HAVING THE SHAPE OF A RECTANGULAR PARALLELEPIPED

[75] Inventor: Petrus W. Van Der Zon, Zwijndrecht, Netherlands

[73] Assignee: Internationale Octrooi Maatschaapij "Octropa" B.V., Rotterdam, Netherlands

[21] Appl. No.: 722,382

[22] Filed: Apr. 12, 1985

[30] Foreign Application Priority Data

Apr. 18, 1984 [NL] Netherlands ..... 8401257

[51] Int. Cl.[4] ..... B65B 11/00

[52] U.S. Cl. ..... 53/397; 53/207; 53/218; 53/228; 53/462; 53/466; 53/580

[58] Field of Search ..... 53/207, 218, 219, 228, 53/230, 397, 462, 594, 466, 580

[56] References Cited

U.S. PATENT DOCUMENTS

| | | | |
|---|---|---|---|
| 2,962,853 | 12/1960 | Howe, Jr. | 53/206 |
| 2,987,860 | 6/1961 | Howe, Jr. | 53/390 |
| 3,138,905 | 6/1964 | Ellinger | 53/207 |
| 3,283,470 | 11/1966 | Oelze et al. | 53/397 |
| 3,872,650 | 3/1975 | Vickers | 53/207 |

FOREIGN PATENT DOCUMENTS

| | | | |
|---|---|---|---|
| 949921 | 2/1964 | United Kingdom | 53/228 |

*Primary Examiner*—John Sipos
*Assistant Examiner*—Donald R. Studebaker
*Attorney, Agent, or Firm*—Cushman, Darby & Cushman

[57] ABSTRACT

A method and apparatus for packaging irregularly shaped articles is provided in which one or more articles is supported on one or more supports, enclosing the supports and the articles in a pack and removing the supports through one or more openings in the pack.

11 Claims, 7 Drawing Figures

METHOD, APPARATUS AND BLANK FOR PACKING AT LEAST ONE ARTICLE IN A SELF-SUPPORTING WRAPPING HAVING THE SHAPE OF A RECTANGULAR PARALLELEPIPED

The invention relates to a method for packing at least one article in a self-supporting wrapping having the shape of a rectangular parallelepiped by folding and fastening a blank of sheet material provide with incisions and folding lines such that the article is entirely enclosed in the wrapping. A similar method is known in the packing technique and generally comprises folding or bending of a blank to form a box, closing said box except for a closable opening, putting the article into the box and closing said box. Further it is known to bend and fasten a band, optionally provided with apertures, around one or more articles, such that the contours of these articles are more or less followed and an irregular shape is obtained.

An object of the invention is packing one or more articles in a wrapping or folding box having a shape which is different from said article, particularly having the shape of a rectangular parallelepiped, which packaging process may be carried out in the transport line of the article.

To that end the invention provides a method of the kind described in the preamble, which is characterized in that one or more articles are supported on one or more supports while the wrapping is applied around one or more articles and partly around these supports, the sheet material is folded and fastened such that the wrapping, in the condition that one or more articles are enclosed therein, presents at least one opening for accommodating one or more supports and that these supports are removed from the wrapping only after one or more articles have been enclosed therein. In this manner, one or more articles of any given shape can be packed in a regularly shaped package in a cheap, rapid manner.

In a preferred embodiment of the method according to the invention, the central upper panel of a blank of sheet material is brought into contact with the upper surface of said article while this article is supported, the side flaps of this blank are connected to opposite sides of both head panels and subsequently the doubling side panels which are connected to opposite sides of the bottom panels are bent downwards, both of the bottom panels connected with the head panels and both of the head panels, each connected with an opposite side of the upper panel are themselves also bent downwards, the doubling side panels are put against the outer faces of the neighbouring side flaps and the side panels, which are each connected to an opposite side of the upper panel, are bent downwards and fastened to the doubling side panels. In the manner described above, a single blank can be arranged by means of simple movements around the article to be packed. Although this is not strictly necessary, the operations described are preferably carried out in the described sequence in order to limit the number of separate movements.

With a view to the workability of the packing material, in can sometimes be desirable to set up the blanks partly before the articles to be packed are brought into them. In that case, it is recommended that first the side flaps, the doubling side panels and the bottom panels all be folded at right angles to the same side of the upper panel and so fastened, and subsequently the other operations be carried out.

For the manufacture of a so-called "look-through" packing, the articles, lying on a piece of transparent material, can be packed in the self-supporting wrapping in such a way that this piece of transparent material comes to lie on the inner side of the wrapping in front of the opening. This piece of transparent material can quite well constitute part of a bag of supple, transparent packing material.

The invention also relates to an apparatus for packing at least one article in a self-supporting wrapping, provided with means for setting up at least one piece of sheet material provided with incisions and folding lines and means for inserting and enclosing the article therein, which according to the invention is provided with supporting means for supporting the article while the wrapping is applied, means for applying the wrapping around the article and partly around the supporting means, and means for subsequently removing the supporting means through at least one opening which is maintained in the wrapping.

In a preferred embodiment, the means for supporting the article are provided with two pairs of angular supports having horizontal legs extending pair-wise approximately in alignment with each other and directed away from each other and having downwardly extending legs which are pair-wise movable towards and away from each other. For the manufacture of rectangular folding cartons, preferably the horizontal legs of both pairs are parallel.

In order to simplify the removal of the supports after application of the wrapping and in order to make practically completely closed wrappings possible, the horizontal legs of both pairs of supports preferably run parallel.

In order to pack a number of rectangular articles, a soft article or an article which is difficult to support on the edge, it is recommendable that the supports of each pair be connected at the level of the under side of the horizontal legs by a suport. Said one or more articles are then reliably supported during the packing step. These supports are preferably plate-shaped and extend along the entire under side of the horizontal legs.

If relatively soft or irregularly shaped articles have to be packed, it is recommended that the apparatus be designed such that the supports form an inner support against which the wrapper is formed and fastened. These supports form, as it were, a mould for forming the packing around it.

In order to increase the dimensional stability, despite possible dimensional variations of the articles to be packed or irregular shapes thereof, the supports preferably define the inner corners of the wrapping.

Finally, the invention relates to a blank for packing an article in a self-supporting wrapping, provided with a rectangular upper panel, having at each of two opposite sides a side wall panel and at each of the other two sides a head panel, which head panels each form the connection between the upper panel and a bottom panel, while, on both sides, in alignment with both side wall panels, doubling side panels are present, only connected with both opposite sides of the head panels and only connected with both opposite sides of both bottom panels, characterized in that the length of the doubling side panels which are in line with each other is together smaller than half of the dimension of the upper panel in the same direction.

With such a blank a folding carton is obtained in which, in the bottom side, an opening is left for supporting the article to be packed duing the packing process.

Although it is possible to move the supports along each other towards each other, preferably the horizontal legs are also used as moulds for forming the folding carton. In this connection it is recommendable that each of the bottom panels has a dimension in at least one main direction which is smaller than a quarter of the corresponding dimension of the upper panel.

In order to keep the article to be packed supported on the original supporting means until the folding carton is ready, at least one opening should remain on the bottom side in that folding carton. It is possible to make this opening relatively small and all the same to close the folding carton completely if both bottom panels along part of both opposite side which are not connected to the head panels are devoid of doubling side panels.

The invention will now be illustrated by the attached drawing, in which some preferred embodiments of the blanks, packings made therewith and of the packing apparatus are shown schematically.

Figure 3:
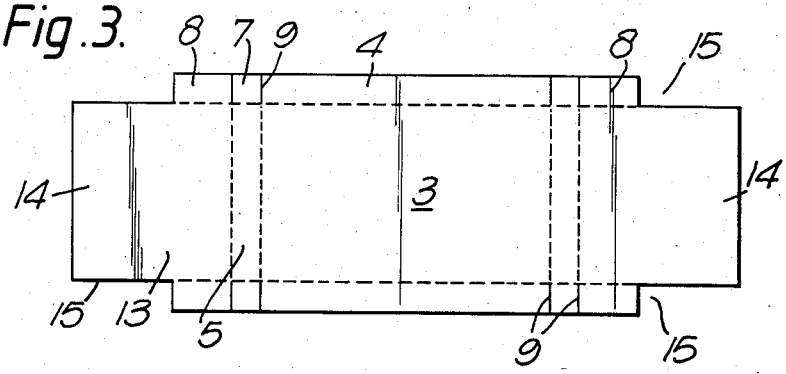

FIG. 3 shown a modified embodiment of a blank according to the invention.

Figure 4:
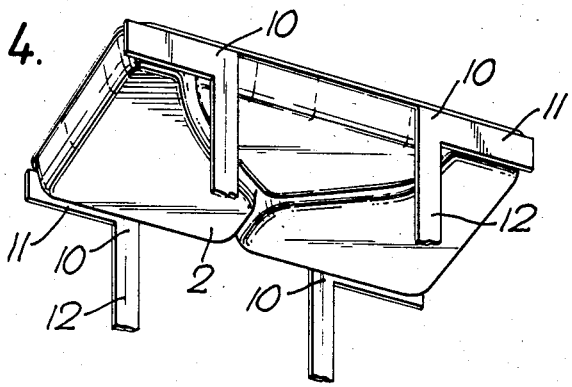

FIG. 4 shows schematically the supports of a packaging apparatus according to the invention with an article resting thereon.

Figure 5:
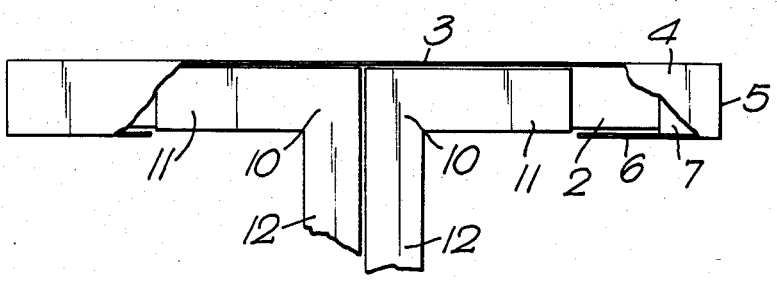

FIG. 5 shows the manner of removing the supports from a completed package.

Figure 6:
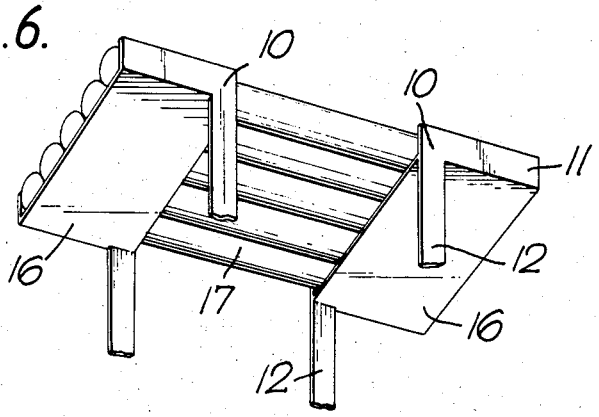

FIG. 6 shows schematically an alternative embodiment of the supports of a packaging apparatus with articles resting thereon.

Figure 7:
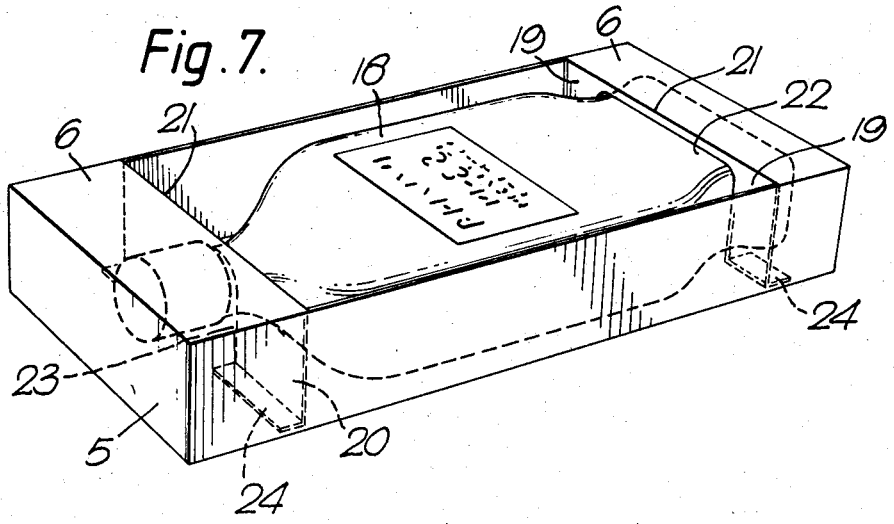

FIG. 7 shows a completed package with a bottle which is fixed therein and is visible.

Figure 1:
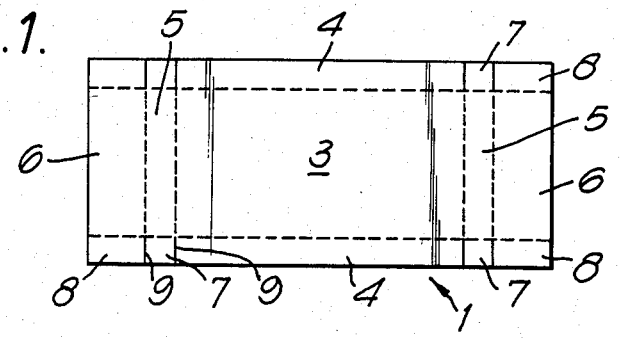
FIG. 1 shows a preferred embodiment of a blank according to the invention.
Figure 2:
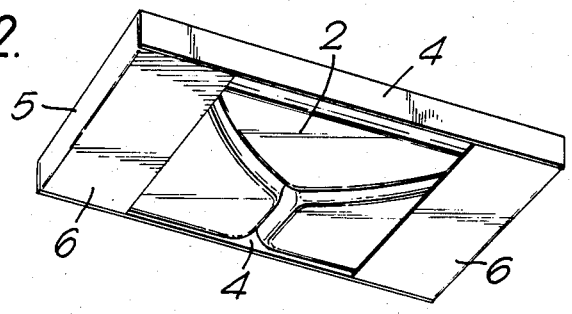
FIG. 2 shows a completed package, made with a blank according to FIG. 1.

In FIG. 1 a blank 1 according to the invention is shown, from which the folding carton drawn in bottom view in FIG. 2 can be folded, arranged around an article, for example a flat menu tray 2. This blank 1 consists of a rectangular piece of carton, which is divided by folding lines and incisions into a central upper panel 3, side panels 4 connected therewith on both sides thereof by folding lines, head panels 5 connected therewith with both other opposite sides thereof by folding lines, each of which carries a bottom panel 6 and, on opposite sides, side flaps 7, while the bottom panels 6 carry doubling side panels 8 on the opposite sides. The side flaps 7 are separated by cutting lines 9 from the neighbouring side panels 4 and doubling side panels 8.

The blank 1 can be folded around the tray 2 by supporting the latter on angular supports 10, this in a manner such that the free ends of the horizontal legs 11 of these supports, directed pair-wise away from each other, are situated under the corners of the tray 1 and these horizontal legs grip precisely under the outwardly directed flange of the tray (see FIG. 4). As drawn, these supports preferably support the long sides of the menu tray in order to prevent bending as much as possible.

The blank drawn in FIG. 1 is subsequently placed with the central top panel 3 on the tray, whereafter the side flaps 7 and subsequently also the doubling side panels 8 are bent downwards. Thereafter, both bottom panels 6 are bent downwards and towards each other against the under side of the tray, while the head panels 5 are bent downwards. The side panels 4 are now bent downwards and united with the corresponding doubling side panels 8 by stapling, gluing or another suitable connecting method.

During these operations, the supports 10 have not only supported the menu tray, but have also formed a rectangular inner mould for applying the wrapping around it and, for example with gluing, for being able to exert sufficient pressure against it on the glue connection.

Subsequently, the supports 10 are brought, from the position shown in FIG. 4, towards each other pairwise, as shown in FIG. 5, and removed downwards out of the package in the direction of the two arrows, so that the package illustrated in perspective bottom view in FIG. 2 is obtained.

In FIG. 3 an alternative embodiment of the blank according to the invention has been drawn. For the most part this corresponds with what is drawn in FIG. 1 and the corresponding parts are indicated with the same reference numbers. The difference is to be found in the bottom panels 13, which are so long that the ends 14, upon their being bent towards each other, come to lie over each other against the under side of the article to be packed and can there be joined. On both sides of each end there are no doubling side panels at 15, so that, after the folding and fastening of the package, splits remain via which angular supports, for example as drawn in FIGS. 4 and 5, can be removed.

In FIG. 6 it is shown in perspective bottom view how the angular supports can be connected pair-wise by a plate-shaped support 16 extending between the under sides of the horizontal legs 11 of these supports, so that a number of bar-shaped articles 17 can be placed thereon and subsequently be packed in the manner described above.

FIG. 7 shows a completed package with, closed in it, a bottle 18, which is visible through the opening. For fixing the bottle, the bottom panels 6 are each provided on the free end with a fixing strip 19 and 20, respectively, each of which has a width corresponding with that of the head panel 5. As a scored line 21 is made between each fixing strip and the adjacent bottom panel, the fixing strips can be folded inwards around the bottle 18, whereby these are enclosed in made-to-fit recesses 22 and 23, respectively, The fixing strips are each fastened in the folded position with the aid of projections 24, for which purpose the projections are glued down or are inserted into splits in the upper panel 3.

What is claimed is:

1. A method of packaging at least one article in a self-supporting wrapping blank of sheet material of the type having a central panel, a plurality of fold lines disposed about said panel and incisions in the sheet material to facilitate folding of the sheet material, comprising the steps of supporting the article on at least one support while disposing the blank substantially around the article and partially around the support by folding the sheet material so as to form at least one opening for accommodating the support, fastening the sheet material to form a complete package while maintaining said opening in the completed package and then moving the support to effect removal of the support from the packaging after the article has been wrapped therein.

2. The method as claimed in claim 15, wherein a plurality of articles are wrapped in said blank.

3. The method as claimed in claim 1 wherein said blank of sheet material includes head panels each having opposite sides and side flaps connected to opposite sides of each of said head panels, said blank further including to bottom panels each having opposite sides to which are connected doubling side panels, said bottom panels being connected to opposite sides of said central panel, said bottom panels being connected to said head panels, said side flaps having outer surfaces, comprising the steps of contacting of the central panel with a surface of the article while the article is supported, bending the doubling side panels at generally right angles to said bottom panel, engaging said doubling side panels against said outer surfaces of said side flaps and bending said side panels to engage said doubling side panels and fastening said side panels to said doubling side panels, said side panels being connected to other opposite sides of said central panel.

4. A method according to claim 3, characterized in that the operations a-f are carried out in the sequence described.

5. A method according to claim 3, characterized in that first the side flaps (7), the doubling side panels (8) and the bottom panels (6) are all folded at an angle to the same side of the upper panel (3) and are fixed in this position, and that subsequently the remaining operations are carried out.

6. A method according to claim 1, characterized in that the articles, lying on a piece of transparent material, are wrapped in the self-supporting warpping in such a manner that this piece of transparent material is arranged at the inner side of the wrapping covering the opening.

7. Apparatus for wrapping at least one article in a self-supporting wrapper having supporting means (10) for supporting the article (2) while the wrapping is wrapped and fastened around the article and partly around the supporting means so as to form at least one opening in the completed package and means for subsequently removing the supporting means through sid opening which is maintained in the wrapping, the means for supporting the article comprising two pairs of angular supports having horizontal legs extending pair-wise in approximate alignment with and directed away from each other and having downwardly extending legs, which are pairwise movable towards and away from each other.

8. Apparatus according to claim 6, characterized in that the horizontal legs (11) of both pairs of supports are parallel.

9. Apparatus according to claim 6, characterized in that the supports (10) of each pair are connected by a support (16) at the level of the under side of the horizontal legs (11).

10. Apparatus according to claim 9, characterized in that the support (16) is plate-shaped and extends along the entire under side of the horizontal legs (11).

11. Apparatus according to claim 6, characterized in that the supports (10) define the inner corners of the wrapping.

* * * * *